US009969172B2

(12) United States Patent
Nishikawa et al.

(10) Patent No.: US 9,969,172 B2
(45) Date of Patent: May 15, 2018

(54) LIQUID CONSUMING APPARATUS AND INK-JET PRINTER

(71) Applicant: BROTHER KOGYO KABUSHIKI KAISHA, Nagoya-shi, Aichi-ken (JP)

(72) Inventors: Yasuo Nishikawa, Nagoya (JP); Toshiro Ueda, Kiyosu (JP); Yuya Tatematsu, Nagoya (JP); Hideo Fukue, Ichinomiya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days. days.

(21) Appl. No.: 15/336,446

(22) Filed: Oct. 27, 2016

(65) Prior Publication Data

US 2017/0120597 A1 May 4, 2017

(30) Foreign Application Priority Data

Oct. 30, 2015 (JP) ..... 2015-214608

(51) Int. Cl.
*B41J 2/17* (2006.01)
*B41J 2/165* (2006.01)
*B41J 2/185* (2006.01)

(52) U.S. Cl.
CPC ..... *B41J 2/1721* (2013.01); *B41J 2/16523* (2013.01); *B41J 2002/1728* (2013.01);
(Continued)

(58) Field of Classification Search
CPC ..... B41J 2/16523; B41J 2/1731; B41J 2002/1728; B41J 2002/1853; B41J 2002/1856
See application file for complete search history.

(56) References Cited

U.S. PATENT DOCUMENTS

2005/0195241 A1 9/2005 Kawai et al.
2009/0219339 A1* 9/2009 Harada ..... B41J 2/1721 347/36

(Continued)

FOREIGN PATENT DOCUMENTS

JP 8-267781 A 10/1996
JP 2003-11394 A 1/2003

(Continued)

OTHER PUBLICATIONS

Hickethier, CR and Lammers, GB, Disposable Cartridge Fluid Collection System, Original Pub. Date Jan. 1, 1998, IP.com Prior Art Database Technical Disclosure, Electronic Pub Date Feb. 14, 2005, IPcom000056709D, TDB 01-88 p. 362-363.*

*Primary Examiner* — Sharon A Polk
(74) *Attorney, Agent, or Firm* — Merchant & Gould P.C.

(57) ABSTRACT

A liquid consuming apparatus includes: a liquid consumer; a liquid receiver; a first waste-liquid storage including (i) a first housing connected to the liquid receiver to allow liquid communication between the first housing and the liquid receiver, and (ii) a first liquid absorber disposed in the first housing; and a second waste-liquid storage including (a) a second housing connected to the first waste-liquid storage to allow liquid communication between the second housing and the first waste-liquid storage, and (b) a second liquid absorber disposed in the second housing. The first housing has a first opening that opens toward the second housing. The second housing has a second opening that opens toward the first housing. The first liquid absorber protrudes from the first opening to an outside of the first housing. The second liquid absorber is in contact with the first liquid absorber protruding from the first opening.

14 Claims, 18 Drawing Sheets

(52) U.S. Cl.
CPC ..... *B41J 2002/1853* (2013.01); *B41J 2002/1856* (2013.01)

(56) References Cited

U.S. PATENT DOCUMENTS

| | | | |
|---|---|---|---|
| 2012/0234436 | A1 | 9/2012 | Harada et al. |
| 2012/0236074 | A1 | 9/2012 | Harada et al. |

FOREIGN PATENT DOCUMENTS

| | | | |
|---|---|---|---|
| JP | 2006-27040 | A | 2/2006 |
| JP | 2009-269195 | A | 11/2009 |
| JP | 2012-196803 | A | 10/2012 |
| JP | 2015-63007 | A | 4/2015 |

* cited by examiner

LIQUID CONSUMING APPARATUS AND INK-JET PRINTER

CROSS REFERENCE TO RELATED APPLICATION

The present application claims priority from Japanese Patent Application No. 2015-214608, which was filed on Oct. 30, 2015, the disclosure of which is herein incorporated by reference in its entirety.

BACKGROUND

Technical Field

The following disclosure relates to a liquid consuming apparatus including a waste-liquid storage that stores liquid sucked from a liquid consumer and to an ink-jet printer.

Description of the Related Art

As one example of liquid consuming apparatuses, there are known ink-jet recording apparatuses including a recording head that ejects ink from ejection openings to record an image on a sheet.

One example of the well-known ink-jet recording apparatuses includes a waste ink storage divided into a fixed waste ink storage and a replaceable movable waste ink storage.

SUMMARY

In the construction in which the waste ink storage is divided into the fixed waste ink storage and the movable waste ink storage, ink smoothly flows between the fixed waste ink storage and the movable waste ink storage. If the ink does not smoothly flow between the fixed waste ink storage and the movable waste ink storage, and thereby the ink accumulates at an area where the fixed waste ink storage and the movable waste ink storage are connected to each other, the ink becomes solid due to drying, which may hider subsequent ink communication.

Accordingly, an aspect of the disclosure relates to a liquid consuming apparatus and an ink-jet printer including a first waste-liquid (waste-ink) storage and a second waste-liquid storage, with smooth liquid communication therebetween.

In one aspect of the disclosure, a liquid consuming apparatus includes: a liquid consumer that consumes liquid; a liquid receiver that receives the liquid discharged from the liquid consumer; a first waste-liquid storage including (i) a first housing connected to the liquid receiver so as to allow communication of the liquid between the first housing and the liquid receiver, and (ii) a first liquid absorber disposed in the first housing; and a second waste-liquid storage including (a) a second housing connected to the first waste-liquid storage so as to allow communication of the liquid between the second housing and the first waste-liquid storage, and (b) a second liquid absorber disposed in the second housing. The first housing has a first opening that opens toward the second housing. The second housing has a second opening that opens toward the first housing. The first liquid absorber protrudes from the first opening to an outside of the first housing. The second liquid absorber is in contact with the first liquid absorber protruding from the first opening.

The liquid discharged from the liquid consumer and received by the liquid receiver flows to the second waste-liquid storage via the first waste-liquid storage. The first liquid absorber protrudes from the first opening of the first housing, and the protruding first liquid absorber and the second liquid absorber are in contact with each other.

Accordingly, the first liquid absorber and the second liquid absorber are reliably kept in contact with each other, enabling smooth liquid communication therebetween.

In another aspect of the disclosure, an ink-jet printer includes: an ink-jet head; a first waste-ink storage including a first housing and a first liquid absorber disposed in the first housing; a second waste-ink storage including a second housing and a second liquid absorber disposed in the second housing; and a waste-ink path connected to the first waste-ink storage, the waste-ink path being connectable to the ink-jet head, wherein the first waste-ink storage is communicated with the ink-jet head via the waste-ink path when the waste-ink path is connected to the ink-jet head. The first liquid absorber protrudes to an outside of the first housing. The second liquid absorber is in contact with the first liquid absorber protruding from the first housing.

Effects

In the above-described liquid consuming apparatus, the liquid smoothly communicates between the first waste-liquid storage and the second waste-liquid storage.

BRIEF DESCRIPTION OF THE DRAWINGS

The objects, features, advantages, and technical and industrial significance of the present invention will be better understood by reading the following detailed description of the embodiment of the invention, when considered in connection with the accompanying drawings, in which.

DETAILED DESCRIPTION OF THE EMBODIMENT

Figure 1:
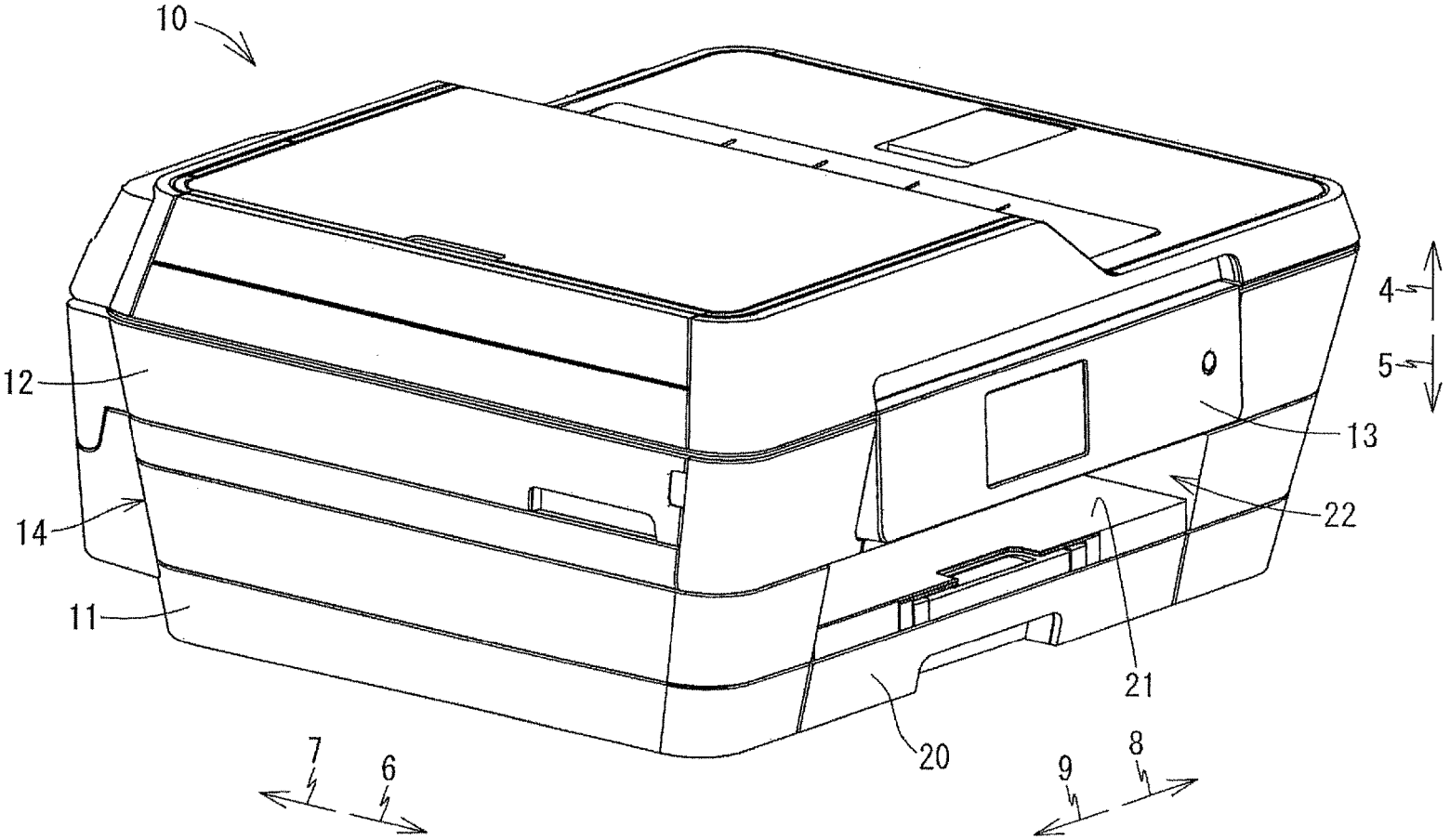
FIG. 1 is an external perspective view of a multi-function peripheral (MFP)

Hereinafter, there will be described one embodiment by reference to the drawings. It is to be understood that the following embodiment is described only by way of example, and the disclosure may be otherwise embodied with various modifications without departing from the scope and spirit of the disclosure. A multi-function peripheral (MFP) 10 is used in a state illustrated in FIG. 1. In the following description, up and down directions 4, 5 (the up and down direction) are defined in this state. Also, front and rear directions 6, 7 (the front and rear direction) are defined by regarding a surface of the MFP 10 which has an opening 22 as a front surface. Right and left directions 8, 9 (the right and left direction) are defined in a state in which the MFP 10 is viewed in the rear direction 7. The up and down directions 4, 5 are opposite each other. The front and rear directions 6, 7 are opposite each other. The right and left directions 8, 9 are opposite each other. The up and down directions 4, 5, the front and rear directions 6, 7, and the right and left directions 8, 9 are orthogonal to each other.

General Structure of MFP 10

The MFP 10 as one example of a liquid consuming apparatus and an ink-jet printer has various functions including a printing function and a scanning function. As illustrated in FIG. 1, the MFP 10 includes a printer housing 11 and a scanner housing 12 disposed on the printer housing 11. The MFP 10 has a generally rectangular parallelepiped outer shape in its entirety. The front surface of the MFP 10 is provided with an operation panel 13 that includes various operation buttons and a liquid crystal display.

Figure 2:
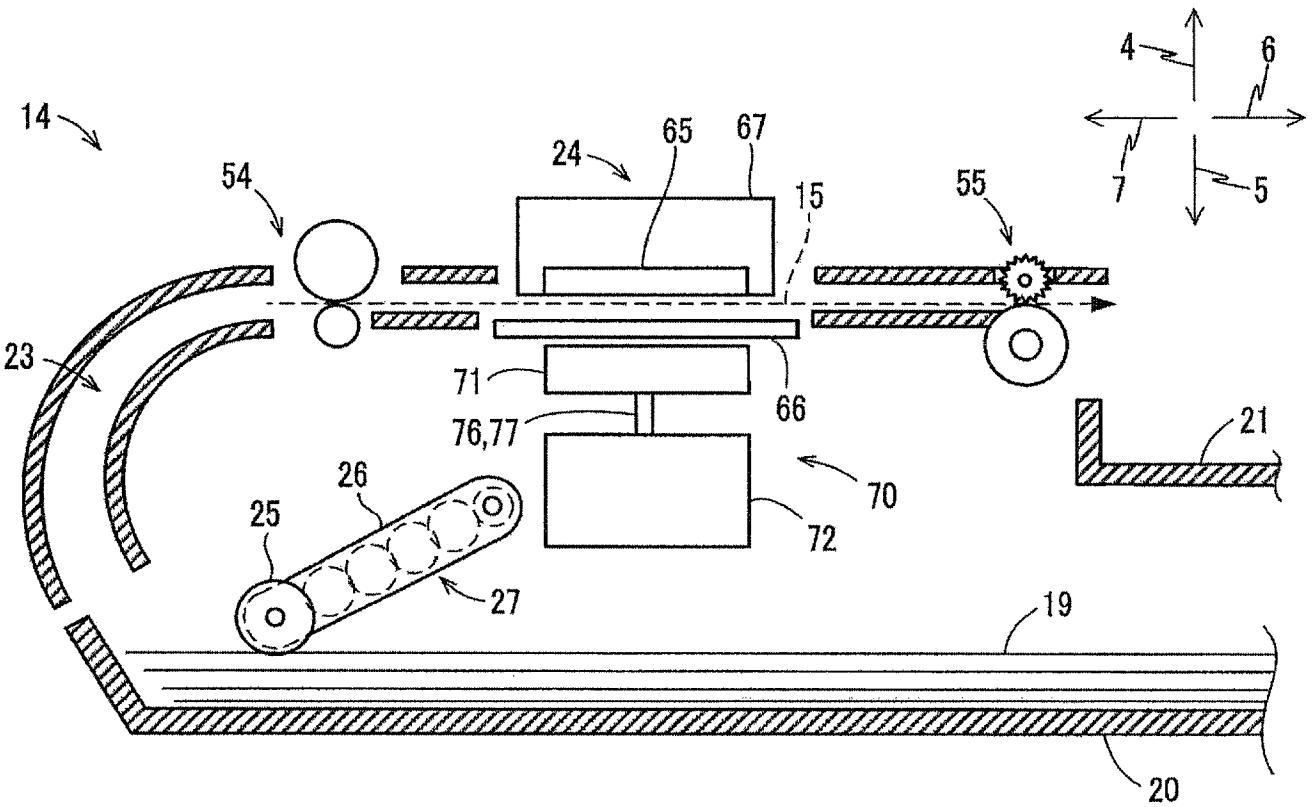
FIG. 2 is a schematic view illustrating an internal structure of a printer housing.

The printer housing 11 serves as outer walls of a printer 14 that records an image on a recording sheet 19 as one example of a sheet. As illustrated in FIG. 2, the printer 14 records an image on the recording sheet 19 conveyed from a supply tray 20 and discharges the image-recorded sheet 19 onto a discharge tray 21. The supply tray 20 and the discharge tray 21 are mountable on and removable from the printer housing 11 through the opening 22 formed in the front surface of the printer housing 11. The scanner housing 12 serves as outer walls of an image reader including a flatbed scanner. A well-known image reader is employed as the image reader, and detailed description and illustration of which are dispensed with.

Printer 14

As illustrated in FIG. 2, a supply roller 25 is disposed on an upper side of the supply tray 20. The supply roller 25 is rotatably supported by a supply arm 26. The supply roller 25 moves in the up and down directions 4, 5 in accordance with change of the thickness of the recording sheets 19 stacked on the supply tray 20. This movement of the supply roller 25 causes pivotal movement of the supply arm 26. The supply roller 25 is rotated by rotation of a motor, not illustrated, which is transmitted by a drive-power transmitting mechanism 27 such as a gear train. The supply roller 25 is rotated while being in contact with an uppermost one of the recording sheets 19 supported on the supply tray 20. This rotation supplies the uppermost recording sheet 19 to a conveyance path 23.

The conveyance path 23 is curved upward and frontward from a rear end portion of the supply tray 20 and extends in the front direction 6 substantially in a straight line toward the discharge tray 21. The conveyance path 23 is located at a substantially central area in the printer housing 11 in the right and left directions 8, 9. A conveying roller pair 54 and a discharge roller pair 55 are provided on the conveyance path 23. The recording sheet 19 nipped by the conveying roller pair 54 and the discharge roller pair 55 is conveyed on the conveyance path 23 in a conveying direction 15. The recording sheet 19 supplied from the supply tray 20 is conveyed by at least one of the conveying roller pair 54 and the discharge roller pair 55 so as to make an upward U-turn along the conveyance path 23. When the recording sheet 19 reaches a position just under an image recorder 24 as one example of a liquid consumer, the image recorder 24 records an image. The recording sheet 19 is then discharged onto the discharge tray 21.

The image recorder 24 is an ink-jet recording device. The image recorder 24 includes a recording head 65 as one example of an ink-jet head and a carriage 67. The carriage 67 is located above the conveyance path 23. The carriage 67 is moved along guide rails, not illustrated, in the right and left directions 8, 9 by receiving power of a motor, not illustrated, which is transmitted by a belt driving mechanism, not illustrated. The recording head 65 is mounted on the carriage 67. A platen 66 is disposed under the recording head 65. The platen 66 extends over an area on which the carriage 67 is moved, in other words, the platen 66 extends over the entire area of the conveyance path 23 in the right and left directions 8, 9. The platen 66 supports a lower surface of the recording sheet 19 conveyed along the conveyance path 23. The recording head 65 is opposed to the platen 66. During movement of the carriage 67 in the right and left directions 8, 9, the recording head 65 selectively ejects ink (as one example of liquid) onto the recording sheet 19 supported on the platen 66, to record an image on the recording sheet 19.

Figure 3:
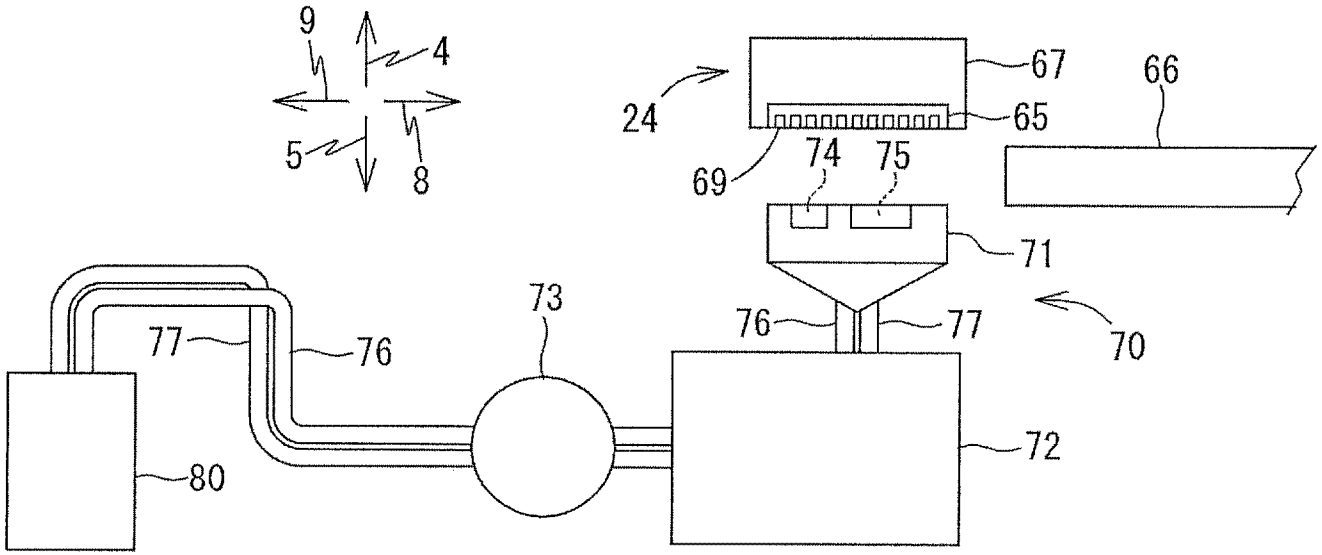
FIG. 3 is a schematic view illustrating constructions of a purging mechanism and a first waste-liquid tank.

As illustrated in FIG. 3, a lower surface of the recording head 65 has a multiplicity of nozzles 69. The nozzles 69 are arranged in four rows each extending in the conveying direction 15. The rows respectively correspond to four colors of ink, namely, cyan, magenta, yellow, and black, for example. Though not illustrated, the recording head 65 is connected to ink cartridges so as to allow ink flow therebetween. The ink cartridges store the ink of the respective four colors. The ink of the four colors is supplied to the recording head 65 from the respective ink cartridges.

Figure 4:
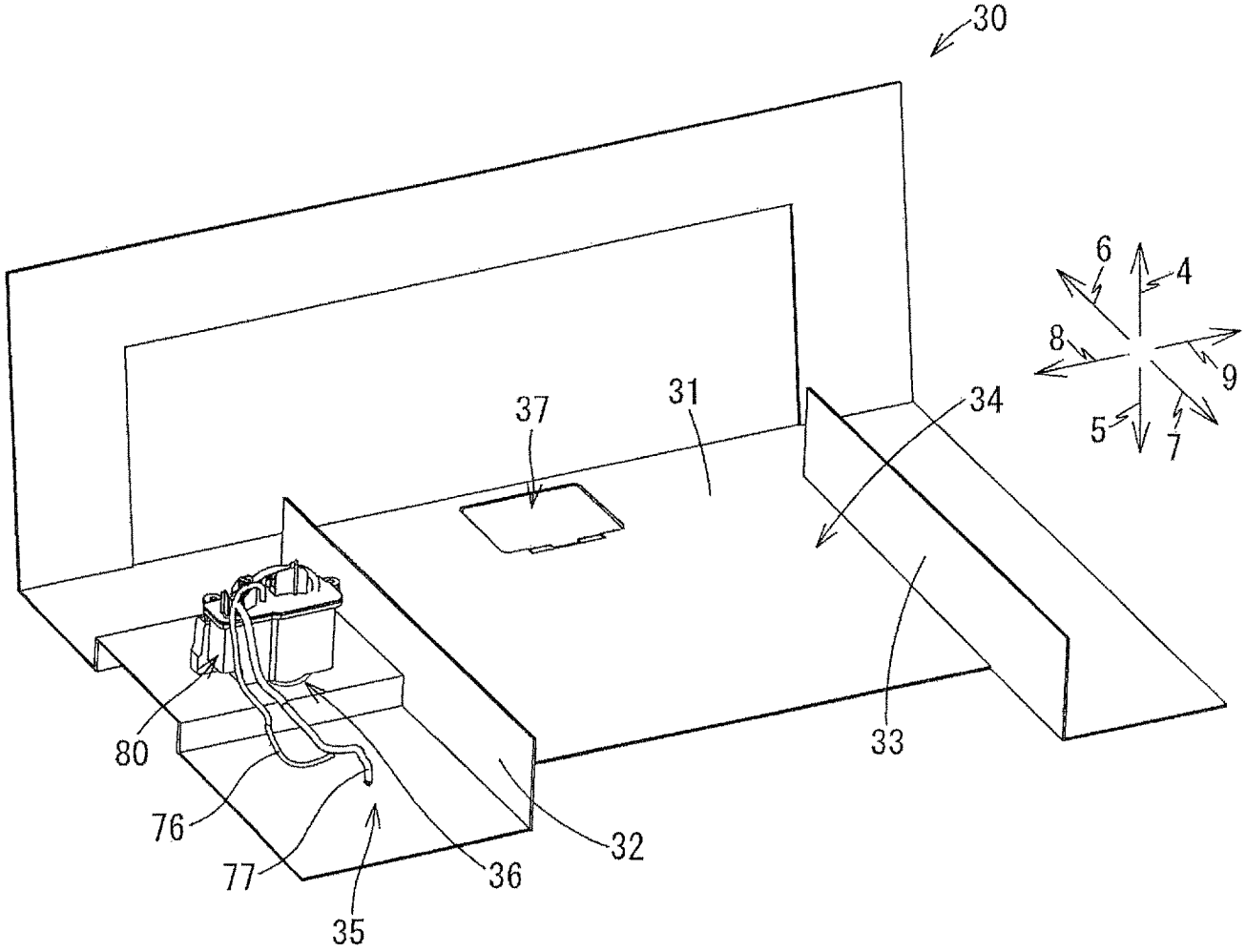
FIG. 4 is a perspective view illustrating a construction of a lower cover.

As illustrated in FIG. 4, the printer housing 11 includes a lower cover 30 that principally serves as a portion of the front surface of the MFP 10 and a lower surface of the MFP 10. Though not illustrated, the printer housing 11 includes an upper cover principally serving as side surfaces and a rear surface of the MFP, and this upper cover is assembled to an upper portion of the lower cover 30 to form the printer housing 11.

The lower cover 30 includes: a bottom board 31 constituting the lower surface of the MFP 10; and a right wall 32 and a left wall 33 which define a space 34 in which the supply tray 20 is to be mounted. The right wall 32 and the left wall 33 protrude upward from the bottom board 31 and extend in the front and rear directions 6, 7 so as to be parallel with each other. The space 34 is located at a central portion of the bottom board 31 in the right and left directions 8, 9 and defined by the right wall 32 and the left wall 33 so as to extend in the front and rear directions 6, 7. A space 35 is formed over the bottom board 31 and to the right of the right wall 32. A purging mechanism 70 and a first waste-liquid tank 80 (as one example of a first waste-liquid storage and a first waste-ink storage) are provided in the space 35. A second waste-liquid tank 110 (as one example of a second waste-liquid storage and a second waste-ink storage) is disposed under the lower cover 30. That is, the first waste-liquid tank 80 is located on an upper side of the second waste-liquid tank 110. It is noted that FIG. 4 does not illustrate the purging mechanism 70.

Purging Mechanism 70

As illustrated in FIG. 3, the purging mechanism 70 is disposed in the space 35 at a position located under a path of movement of the recording head 65 and to the right of a right end of the platen 66. The purging mechanism 70 sucks the ink from the nozzles 69 of the recording head 65 and discharges the sucked ink to the first waste-liquid tank 80. The ink discharged from the nozzles 69 by the purging mechanism 70 will be hereinafter referred to as "waste ink". It is noted that FIG. 3 schematically illustrates the first waste-liquid tank 80 to indicate that the purging mechanism 70 and the first waste-liquid tank 80 are connected to each other by tubes 76, 77, but illustration in FIG. 3 does not indicate a positional relationship between the first waste-liquid tank 80 and the other components.

The purging mechanism 70 includes: a movable member 71; a cam mechanism 72 for moving the movable member 71 in the up and down directions 4, 5; the tubes 76, 77; and a pump 73. The movable member 71 includes caps 74, 75 (each as one example of a liquid receiver) formed of rubber. The caps 74, 75 are opposed to the lower surface of the recording head 65 in the up and down directions 4, 5 in a state in which the carriage 67 is located over the movable member 71. The cam mechanism 72 is operated by power transmitted from a motor, not illustrated, to move the movable member 71 in the up and down directions 4, 5. When the movable member 71 is moved upward, the caps 74, 75 are brought into contact with the lower surface of the recording head 65. In this state, the cap 74 covers the row of the nozzles 69 for ejecting the black ink, and the cap 75 covers the rows of the nozzles 69 for ejecting the cyan, magenta, and yellow ink. One ends of the respective tubes 76, 77 are connected to the caps 74, 75. Each of the tubes 76, 77 is a flexible tube formed of resin.

The pump 73 is a rotary tube pump which is operated by power transmitted from a motor, not illustrated, for example. The tubes 76, 77 establish communication of the pump 73 with a closed space that is formed between the lower surface of the recording head 65 and the caps 74, 75. When the pump 73 is driven in the state in which the nozzles 69 are covered with the caps 74, 75, a negative pressure is generated in the caps 74, 75, so that the ink discharged from the nozzles 69 is received by the caps 74, 75. The waste ink received by the caps 74, 75 flows to the first waste-liquid tank 80 by the pump 73 through the tubes 76, 77. The waste ink principally flows in the tube 76, and an atmosphere principally flows in the tube 77. It is noted that the caps 74, 75, the pump 73, and the tubes 76, 77 are one example of a waste-ink path.

First Waste-Liquid Tank 80

As illustrated in FIG. 4, the first waste-liquid tank 80 is provided in the space 35 located on the lower cover 30. Though not illustrated, the purging mechanism 70 is located at a rear of the first waste-liquid tank 80. The tubes 76, 77 connected to the purging mechanism 70 extend in the front direction 6 so as to be connected to the first waste-liquid tank 80. A through hole 36 is formed in the bottom board 31 of the lower cover 30 which is located under the space 35. A cylindrical portion 87 of the first waste-liquid tank 80 is inserted in the through hole 36 and secured to the lower cover 30 by a screw, not illustrated.

Figure 5:
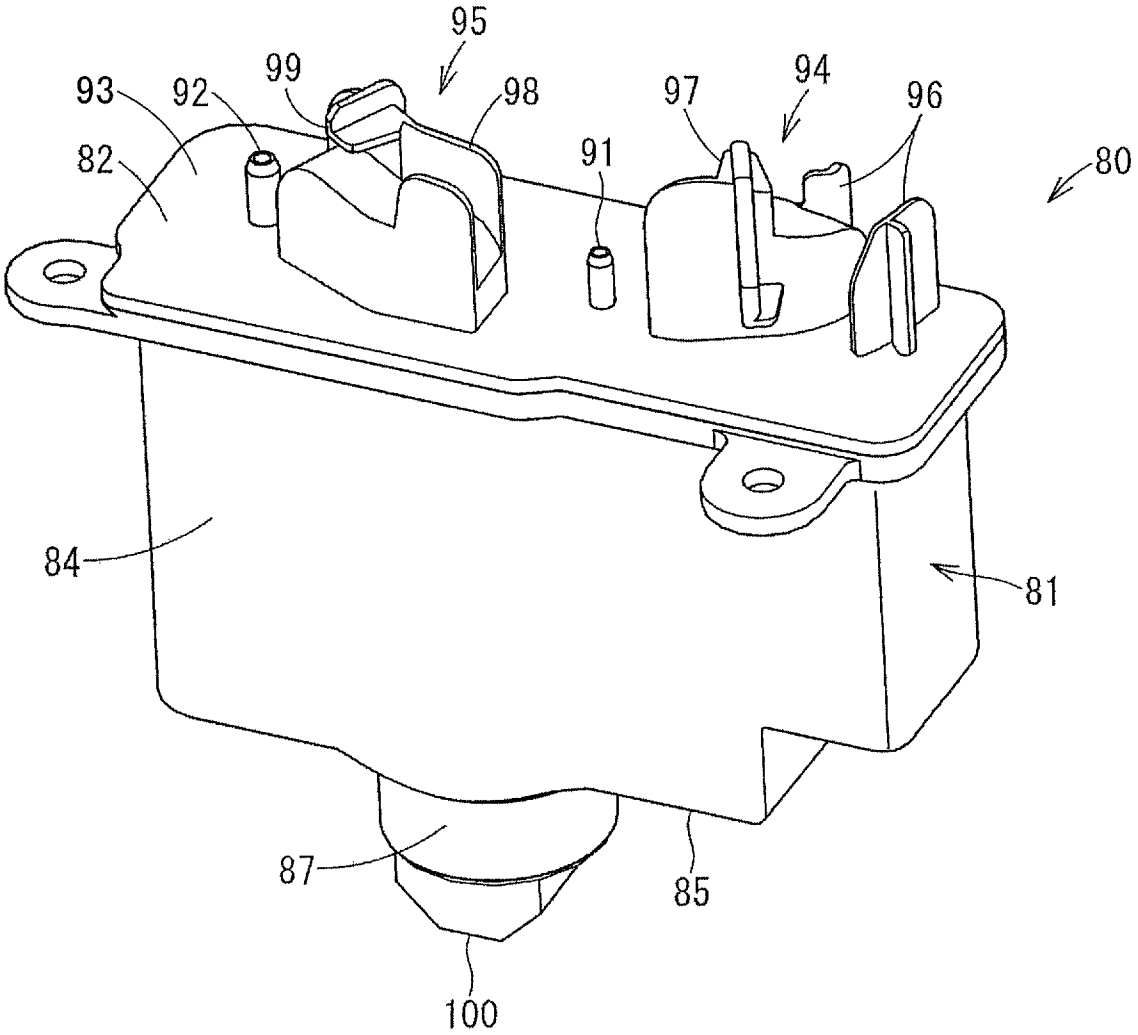
FIG. 5 is an external perspective view of the first waste-liquid tank.
Figure 6:
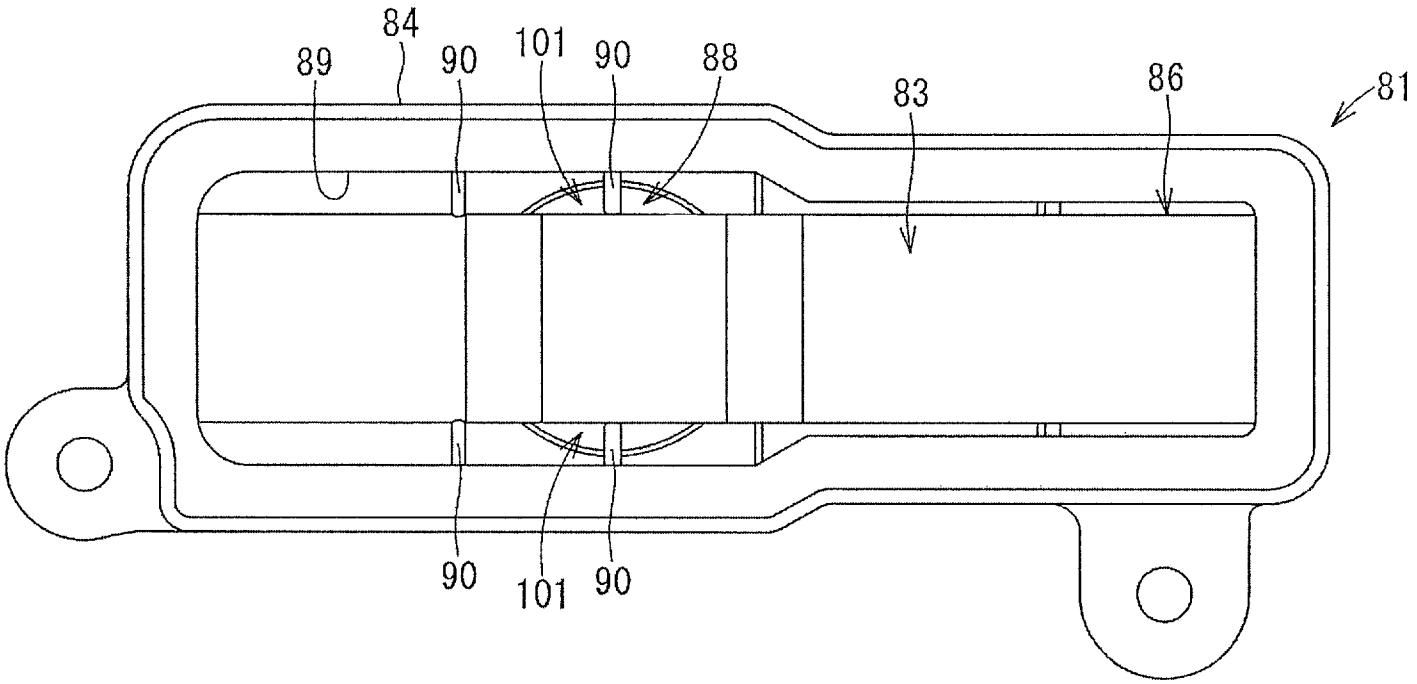
FIG. 6 is a plan view of a body and an ink absorber.
Figure 7:
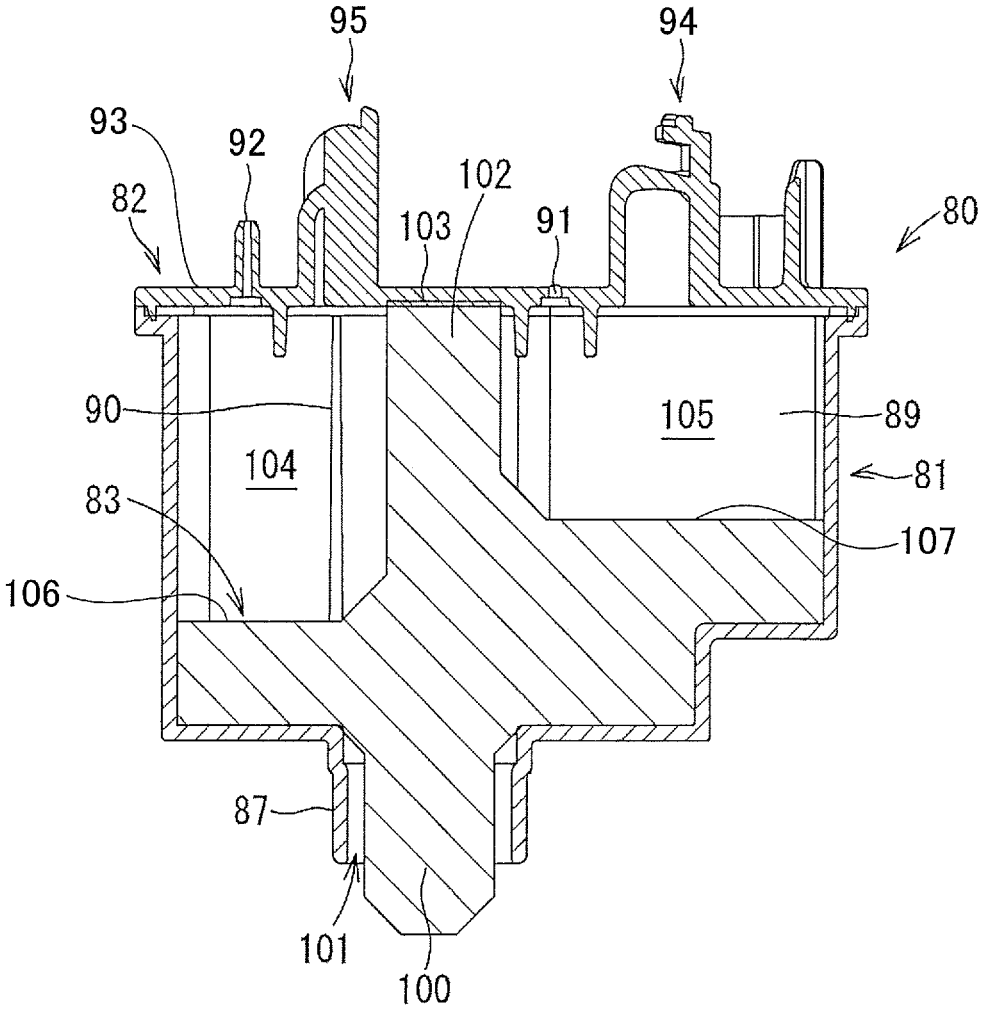
FIG. 7 is an elevational view in vertical cross section illustrating the first waste-liquid tank.

As illustrated in FIGS. 5-7, the first waste-liquid tank 80 includes a body 81 (as one example of a first housing), a lid 82 (as one example of a positioning member), and an ink absorber 83 (as one example of a first liquid absorber). The body 81 and the lid 82 are one example of a first housing.

As illustrated in FIG. 6, the body 81 is shaped like a hollow box including a side wall 84 and a bottom board 85 (as one example of a bottom surface). The body 81 has an opening 86 (as one example of a third opening) on its upper side. The opening 86 is rectangular in plan view and defined by an upper end of the side wall 84 shaped like a quadrangular prism. The cylindrical portion 87 (as one example of a first opening) extends in the down direction 5 from the bottom board 85 of the body 81. The cylindrical portion 87 is hollow and has an opening 88 in its lower end. Spaces inside and outside the body 81 communicate with each other through the cylindrical portion 87. The cylindrical portion 87 is located at a substantially center of the long sides of the rectangular shape of the bottom board 85 in the right and left directions 8, 9.

Four ribs 90 protrude from a side surface 89 as an inner surface of the side wall 84 which defines an inner space of the body 81. Each of the ribs 90 is provided on a corresponding side of the opening 88 formed in the cylindrical portion 87. Specifically, the ribs 90 are provided in front of and at a rear of the opening 88. The ribs 90 protrude inwardly from the side surface 87 and extend in the up and down directions 4, 5. Lower ends of the respective ribs 90 are continuous to the bottom board 85. Protruding ends of the respective ribs 90 contact the ink absorber 83 provided in the space defined in the body 81.

As illustrated in FIGS. 5 and 7, the opening 86 formed in the body 81 is sealed with the lid 82. The lid 82 is provided with port defining members 91, 92 to which the respective tubes 76, 77 are connected. Each of the port defining members 91, 92 is shaped like a pipe having a round shape in cross section. The port defining members 91, 92 protrude upward from the lid 82. Each of the port defining members 91, 92 has an inner space that extends through the lid 82. The inner spaces of the respective port defining members 91, 92 establish communication between the inner space of the body 81 and the outside. The port defining members 91, 92 are spaced apart from each other in plan view in the direction of the long sides of the rectangular shape of the lid 82. The port defining member 92 is nearer to an end of the body 81 than the ribs 90 in the direction of the long sides of the lid 82, i.e., in the right and left directions 8, 9 established in a state in which the first waste-liquid tank 80 is disposed on the lower cover 30. Each of the inner spaces of the respective port defining members 91, 92 is one example of a port.

Tube supporters 94, 95 are provided on an upper surface 93 of the lid 82. The tube supporter 94 supports the tube 76 connected to the port defining member 91. The tube supporter 95 supports the tube 77 connected to the port defining member 92. The tube supporter 94 includes: a nip portion 96 that nips the tube 76 in the horizontal direction; and a holding portion 97 that inhibits movement of the tube 76 in the up direction 4.

Figure 11:
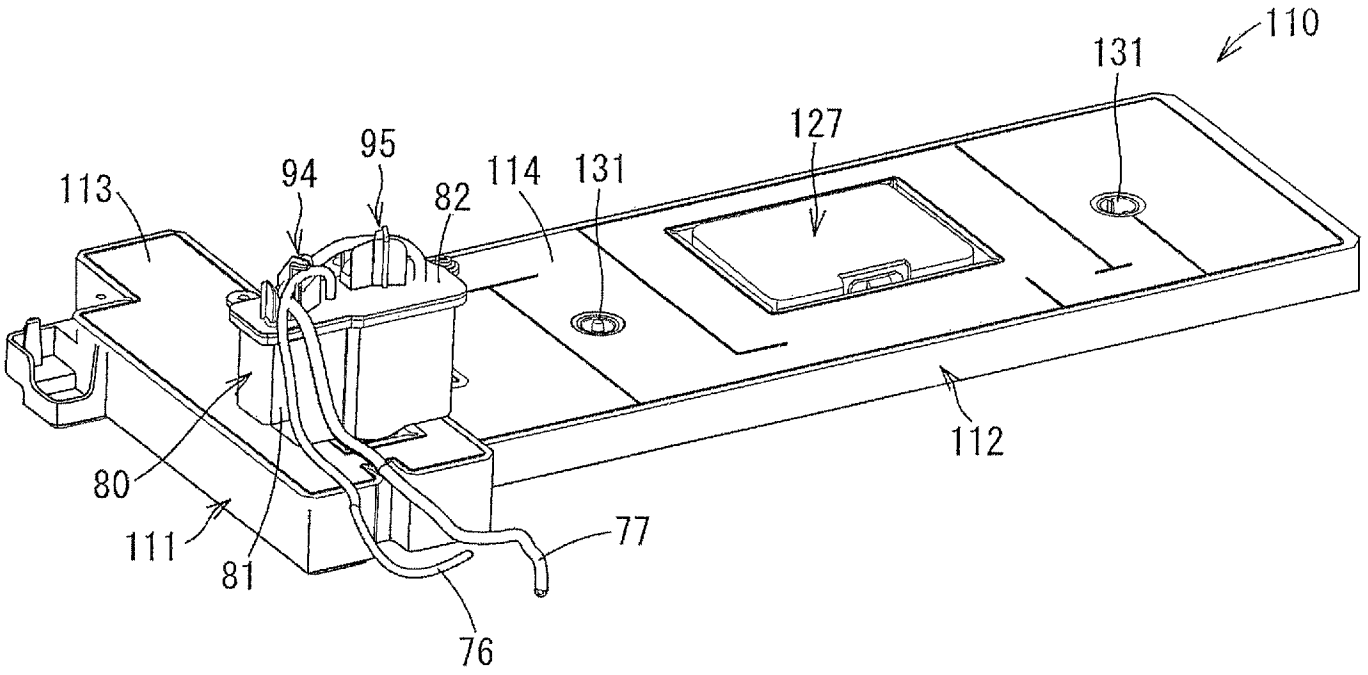
FIG. 11 is a perspective view of the first waste-liquid tank and the second waste-liquid tank.

As illustrated in FIGS. 4 and 11, the tube 76 first extends from the port defining member 91 in the up direction 4 and contacts the holding portion 97 which inhibits the extension of the tube 76 in the up direction 4, so that the tube 76 is curved so as to extend in the down direction 5. The tube 76 is nipped by the nip portion 96 in the state in which the tube 76 is curved in the down direction 5. This nip inhibits movement of the tube 76 in the front and rear directions 6, 7 and in the right and left directions 8, 9. The tube supporter 95 includes: a nip portion 98 that nips the tube 77 in the horizontal direction; and a holding portion 99 that inhibits movement of the tube 77 in the up direction 4. The tube 77 first extends from the port defining member 92 in the up direction 4 and contacts the holding portion 99 which inhibits the extension of the tube 77 in the up direction 4, so that the tube 77 is curved so as to extend in the down direction 5. The tube 77 is nipped by the nip portion 98 in the state in which the tube 77 is curved in the down direction 5. This nip inhibits movement of the tube 77 in the front and rear directions 6, 7 and in the right and left directions 8, 9.

When the first waste-liquid tank 80 is disposed on the lower cover 30 in the state in which the tubes 76, 77 are supported by the respective tube supporters 94, 95, an uppermost portion of each of the tubes 76, 77 is located below the caps 74, 75 positioned when the movable member 71 of the purging mechanism 70 is located at its lowermost position.

As illustrated in FIG. 7, the ink absorber 83 is provided in the inner space of the body 81, with the opening 86 sealed with the lid 82. The ink absorber 83 is formed of a fabric material and constituted by a felt component, for example. The waste ink having flowed into the inner space of the body 81 is absorbed and retained by the ink absorber 83.

The ink absorber 83 extends in the body 81 so as to cover substantially the entirety of the bottom board 85. A most portion of the ink absorber 83 is disposed in a lower portion of the inner space of the body 81. Spaces are formed in some areas between the ink absorber 83 and the lid 82.

The ink absorber 83 includes a first protrusion 100 protruding in the down direction 5. The first protrusion 100 has a generally quadrangular prism shape. The first protrusion 100 is inserted in an inner space of the cylindrical portion 87 of the body 81. A lower end portion of the first protrusion 100 protrudes from the opening 88 of the cylindrical portion 87 to the outside of the body 81. That is, a lower end of the ink absorber 83 is located below a lower end of the body 81 and exposed to the outside of the body 81. The inner space of the cylindrical portion 87 has a round shape in plan view, and the first protrusion 100 has a quadrangle shape in horizontal cross section. Thus, a space 101 is formed between the cylindrical portion 87 and the first protrusion 100.

The ink absorber 83 has a second protrusion 102 protruding upward. The second protrusion 102 has a generally quadrangular prism shape. The second protrusion 102 is located substantially just above the first protrusion 100. In the inner space of the body 81, an upper surface 103 of the second protrusion 102 is in contact with the lid 82. The upper surface 103 of the second protrusion 102 is in contact with a portion of the lid 82 which is located between the port defining member 91 and the port defining member 92. The ink absorber 83 is not in contact with the lid 82 at its portion other than the upper surface 103 of the second protrusion 102. Thus, the second protrusion 102 partitions the inner space of the body 81 into (i) a space 104 communicating with the port defining member 91 and (ii) a space 105 communicating with the port defining member 92. An upper surface 106 of the ink absorber 83 which defines the space 104 is located below an upper surface 107 of the ink absorber 83 which defines the space 105. It is noted that the space 104 and the space 105 are not necessarily separated from each other completely.

Second Waste-Liquid Tank 110

Figure 8:
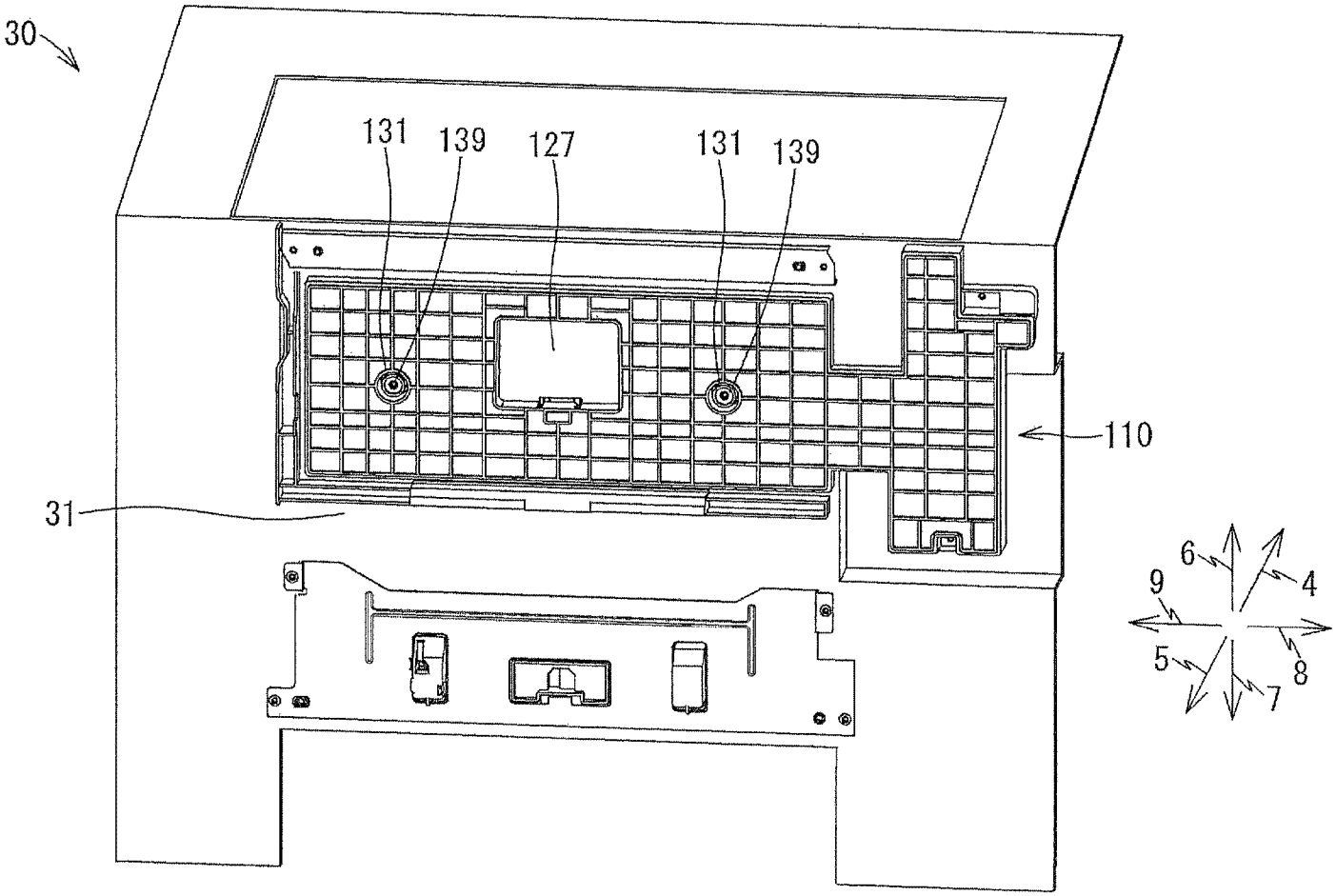
FIG. 8 is a perspective view of the lower cover and a second waste-liquid tank viewed from the bottom.

As illustrated in FIG. 8, the second waste-liquid tank 110 is disposed under the bottom board 85 of the lower cover 30. Though not illustrated, the cylindrical portion 87 of the first waste-liquid tank 80 disposed on the bottom board 31 of the lower cover 30 protrudes in the down direction 5 from the bottom board 31 through the through hole 36 formed through the bottom board 31.

Figure 9:
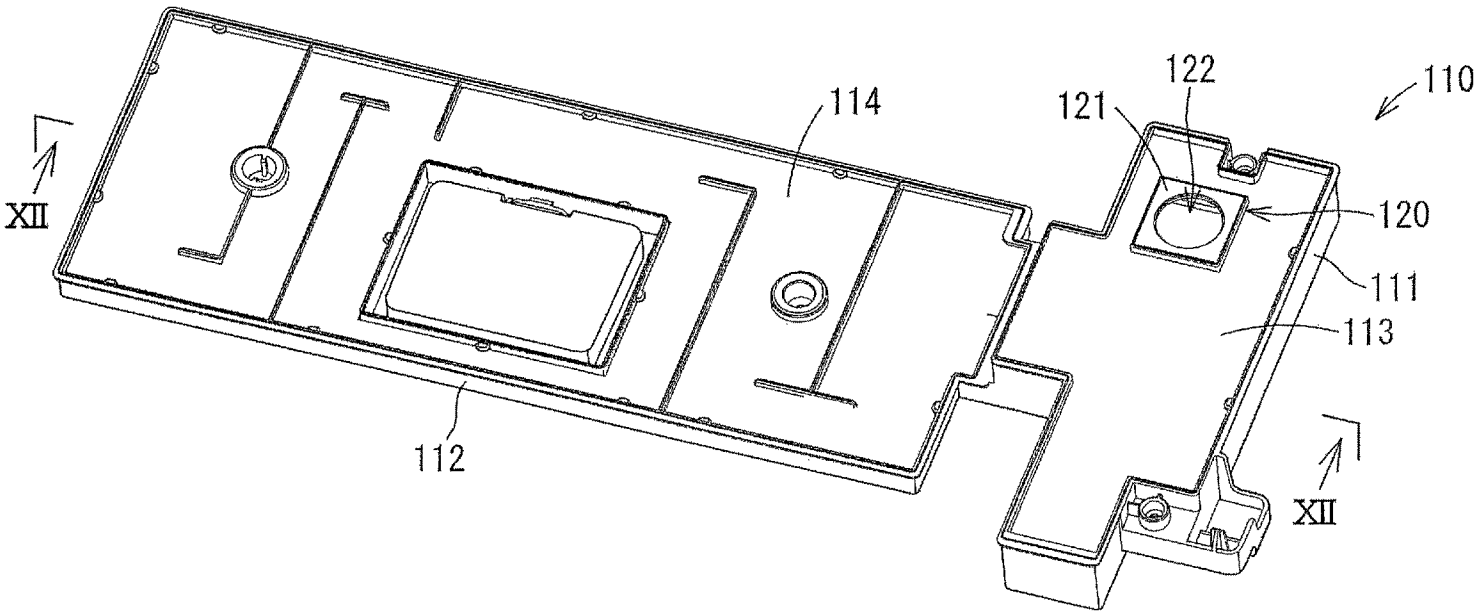
FIG. 9 is a perspective view of the second waste-liquid tank.
Figure 10:
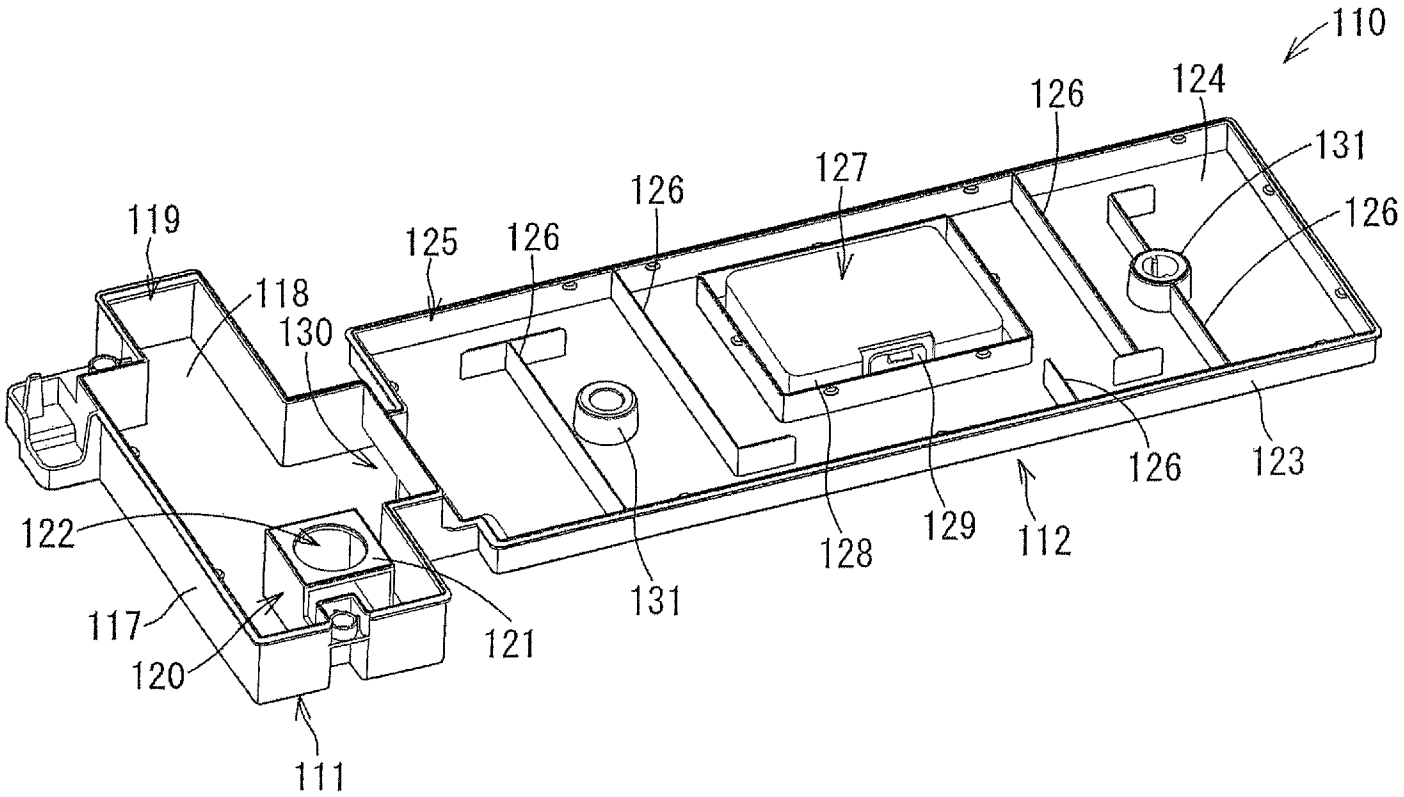
FIG. 10 is a perspective view of a first body and a second body.

As illustrated in FIGS. 9-11, the second waste-liquid tank 110 includes a first body 111, a second body 112, sheets 113, 114, and ink absorbers 115, 116 (each one example of a second liquid absorber). The capacity of the second waste-liquid tank 110 for storage of the waste ink is greater than that of the first waste-liquid tank 80 for storage of the waste ink. The first body 111 and the second body 112 are one example of a second housing. The first body 111, the second body 112, and the sheets 113, 114 are another example of the second housing.

As illustrated in FIG. 10, the first body 111 is a hollow box having a side wall 117 and a bottom board 118. The first body 111 opens upward and has an opening 119. The first body 111 is thin and flat and has a generally rectangular parallelepiped shape as an outer shape. The opening 119 is defined by an upper end of the side wall 117. A projection 120 (as one example of a second opening) protruding in the up direction 4 is provided on the bottom board 118 of the first body 111. The projection 120 is hollow and opens in its front and rear portions. An opening 122 is formed in a top board 121 of the projection 120. The opening 119 of the first body 111 is closed by the sheet 113 except for the opening 122 formed in the top board 121 of the projection 120. That is, the sheet 113 opens at its portion corresponding to the opening 122, and this opening is also one example of the second opening.

The second body 112 is a hollow box having a side wall 123 and a bottom board 124. The second body 112 opens upward and has an opening 125. The second body 112 is thin and flat and has a generally rectangular parallelepiped shape as an outer shape. The opening 125 is defined by an upper end of the side wall 123. A plurality of ribs 126 are provided on the second body 112. The ribs 126 protrude from the bottom board 124 in the up direction 4 and extend in the front and rear directions 6, 7. A front end or rear end of each of the ribs 126 is bent in one or both of the right direction 8 and the left direction 9. Thus, each of the ribs 126 is shaped like a hook in plan view. The ribs 126 are spaced apart from each other in the right and left directions 8, 9.

An engaging portion 127 is provided on the second body 112 at its central portion in the right and left directions 8, 9 so at to protrude from the bottom board 124 in the up direction 4. The engaging portion 127 has a generally rectangular parallelepiped shape. An engaging hook 129 is provided on a rear surface 128 of the engaging portion 127. The engaging hook 129 protrudes in the up direction 4 so as to gradually increase a distance from the rear surface 128 to the engaging hook 129. A protruding end of the engaging hook 129 is bent like a hook. The engaging hook 129 is elastically deformable so as to move toward the rear surface 128.

As illustrated in FIG. 4, a through hole 37 is formed in the bottom board 31 of the lower cover 30. The through hole 37 has a rectangular shape in plan view which corresponds to the outer shape of the engaging portion 127. The engaging portion 127 is fitted in the through hole 37. The engaging hook 129 is engaged with an edge of the through hole 37 in the state in which the engaging portion 127 is fitted in the through hole 37. This engagement secures the second body 112 in a state in which the second body 112 is located under the bottom board 31 of the lower cover 30, thereby preventing disengagement of the second body 112 from the lower cover 30 in the down direction 5.

As illustrated in FIG. 10, the second body 112 is provided with two bosses 131 protruding from the bottom board 124 in the up direction 4. Each of the bosses 131 has a cylindrical shape. Screws 139 (see FIG. 8) are to be inserted in the respective bosses 131. As described above, in the state in which the second body 112 is located under the bottom board 31 of the lower cover 30, the screws 139 inserted through the respective bosses 131 are engaged with the bottom board 31 of the lower cover 30, thereby securing the second body 112 to the lower cover 30. The opening 125 formed in the second body 112 is closed by the sheet 114 except for the engaging portion 127 and the bosses 131.

The first body 111 and the second body 112 are formed integrally with each other in a state in which the first body 111 is located to the right of the second body 112. That is, the first body 111 and the second body 112 are connected to each other. Thus, when the second body 112 is secured to the bottom board 31 of the lower cover 30, the first body 111 is also secured to the lower cover 30. In this state, the first body 111 is located just under the space 34 of the lower cover 30, and the second body 112 is located just under the space 35 of the lower cover 30.

The side wall 117 of the first body 111 is open at a portion facing the second body 112, and the side wall 123 of the second body 112 is open at a portion facing the first body 111. These openings serve as one opening 130. The inner space of the first body 111 and the inner space of the second body 112 communicate with each other through the opening 130.

Figure 12:
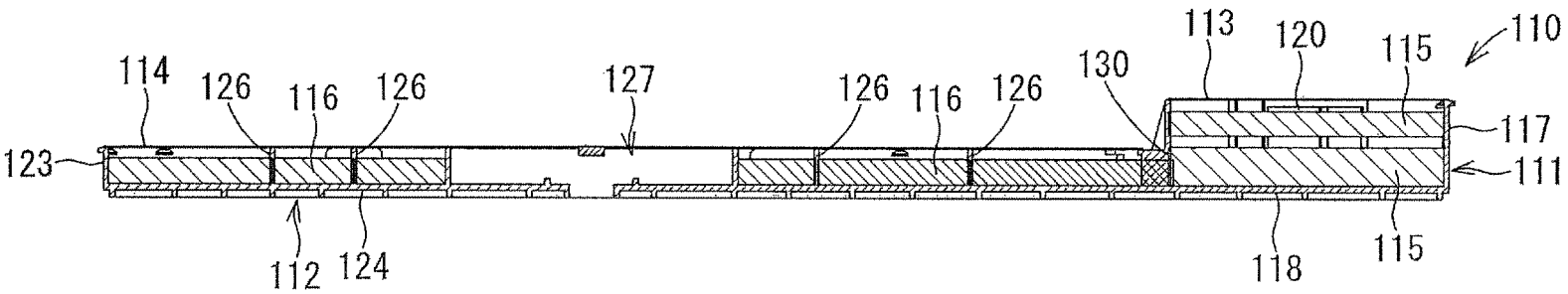
FIG. 12 is a cross-sectional view taken along line XII-XII in FIG. 9.

As illustrated in FIG. 12, the ink absorber 115 is provided in the inner space of the first body 111. The ink absorber 115 is formed of a fabric material and constituted by a felt component, for example. The ink absorber 115 is also disposed in the projection 120.

Figure 13:
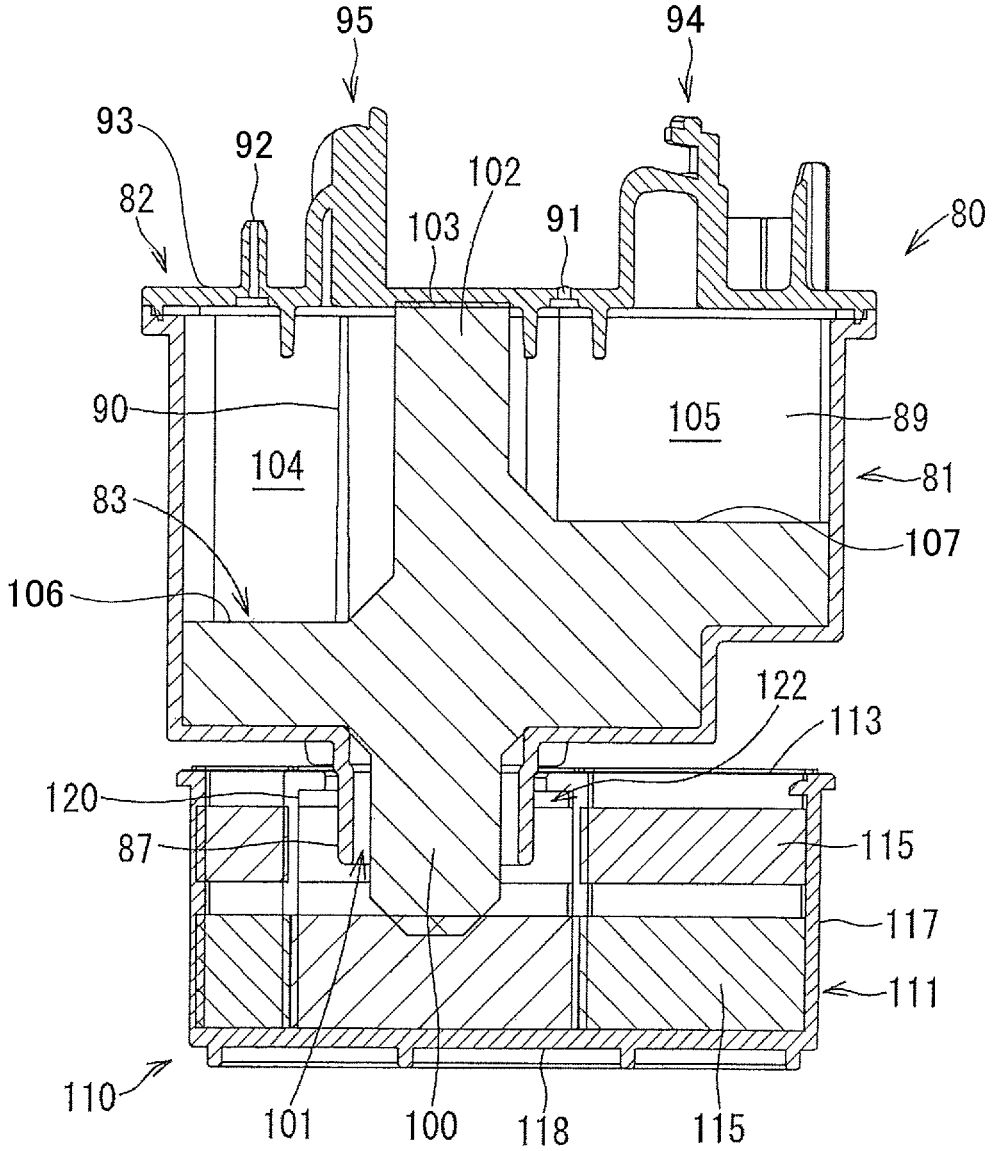
FIG. 13 is a cross-sectional view taken along line XIII-XIII in FIG. 12.

As illustrated in FIG. 13, in the state in which the first waste-liquid tank 80 and the second waste-liquid tank 110 are secured to the lower cover 30, the ink absorber 83 protruding to the outside of the first waste-liquid tank 80 from the cylindrical portion 87 of the body 81 of the first waste-liquid tank 80 enters the inner space of the second waste-liquid tank 110 through the opening 122 of the projection 120 of the second waste-liquid tank 110, and the ink absorber 83 is in pressing contract with the ink absorber 115. The waste ink having flowed into the inner space of the body 81 flows into the inner space of the first body 111 of the second waste-liquid tank 110 through the ink absorber 83 and absorbed and retained by the ink absorber 115.

As illustrated in FIG. 12, the ink absorber 116 is provided in the inner space of the second body 112. The ink absorber 116 is formed of a fabric material and constituted by a felt component, for example. The ink absorber 115 provided in the inner space of the first body 111 and the ink absorber 116 provided in the inner space of the second body 112 are held in contact with each other through the opening 130. Thus, the waste ink having flowed into the inner space of the first body 111 flows into the inner space of the second body 112 through the ink absorber 115 and absorbed and retained by the ink absorber 116.

In the case where the second waste-liquid tank 110 is filled to capacity with the waste ink, only the second waste-liquid tank 110 is removed from the lower cover 30 and replaced with new one. That is, the second waste-liquid tank 110 can be replaced only by removing the screws 139 securing the second waste-liquid tank 110 from a lower portion of the MFP 10 to disengage the engaging portion 127 of the second waste-liquid tank 110 from the lower cover 30, without disassembling the MFP 10 to such a degree that a user can access the internal structure of the printer 14 such as the purging mechanism 70. During this replacement, the stored waste ink is absorbed and retained in the ink absorber 83 in the first waste-liquid tank 80. Accordingly, even when the cylindrical portion 87 of the first waste-liquid tank 80 is exposed to the outside by removal of the second waste-liquid tank 110 from the lower cover 30, the waste ink does not drip or flow to the outside from the first waste-liquid tank 80.

Effects

The waste ink sucked from the recording head 65 by the purging mechanism 70 flows to the second waste-liquid tank 110 via the first waste-liquid tank 80. The first protrusion 100 of the ink absorber 83 provided in the inner space of the first waste-liquid tank 80 protrudes from the cylindrical portion 87 of the body 81 to the outside of the body 81. The protruding first protrusion 100 and the ink absorber 115 provided in the inner space of the second waste-liquid tank 110 are held in contact with each other. Thus, the ink absorber 83 and the ink absorber 115 are reliably kept in contact with each other, enabling smooth flow of the waste ink therebetween.

The body 81 of the first waste-liquid tank 80 is located above the first body 111 of the second waste-liquid tank 110. Thus, gravity causes the liquid to flow from the body 81 toward the first body 111.

The first waste-liquid tank 80 has the space 101 formed between an inner wall of the cylindrical portion 87 and the first protrusion 100 of the ink absorber 83. The inner space of the body 81 is open to the atmosphere through the space 101.

The first waste-liquid tank 80 includes the ribs 90 protruding from the side surface 89 and continuous to the bottom board 85, and the ink absorber 83 is in contact with the ribs 90. Thus, the waste ink flowing along the side surface 89 of the body 81 is guided to the ink absorber 83 by the ribs 90.

In the first waste-liquid tank 80, the second protrusion 102 of the ink absorber 83 provided in the inner space of the body 81 is in contact with the lid 82. This contact reduces change of the position of the ink absorber 83 in the inner space of the body 81.

The tube supporters 94, 95 provided on the lid 82 of the first waste-liquid tank 80 respectively support the tubes 76, 77 extending from the respective port defining members 91, 92 in the up direction 4 in the state in which the tubes 76, 77 are curved in the down direction 5. This construction reduces backflow of the waste ink from the tubes 76, 77 toward the respective caps 74, 75. Also, since the movement of the tubes 76, 77 in the up direction 4 is inhibited, the tubes 76, 77 are not moved to positions above the caps 74, 75. As a result, it is possible to prevent the backflow of the waste ink from the tubes 76, 77 to the respective caps 74, 75.

In the inner space of the body 81 of the first waste-liquid tank 80, the ink absorber 83 separates the space 104 communicating with the port defining member 91 and the space 105 communicating with the port defining member 92, from each other. With this construction, the waste ink having flowed from the port defining member 91 into the inner space of the body 81 is prevented from flowing toward the port defining member 91 by the ink absorber 83.

The second body 112 of the second waste-liquid tank 110 is provided with the ribs 126 protruding from the bottom board 124 in the up direction 4 and bent like hooks. Thus, even in the case where the second body 112 is inclined, for example, such that one of right and left walls of the MFP 10 is lower than the other, the waste ink is retained by the bent portions of the ribs 126 without dripping. This retention reduces a possibility that the waste ink in the second body 112 flows through the opening 122 formed in the projection 120 of the first body 111, for example.

The waste ink sucked from the recording head 65 by the purging mechanism 70 finally arrives at the above-described second waste-liquid tank 110. Thus, a sensor for detecting the ink may be provided on the second waste-liquid tank 110 at a position at which the waste ink finally arrives.

Figure 14:
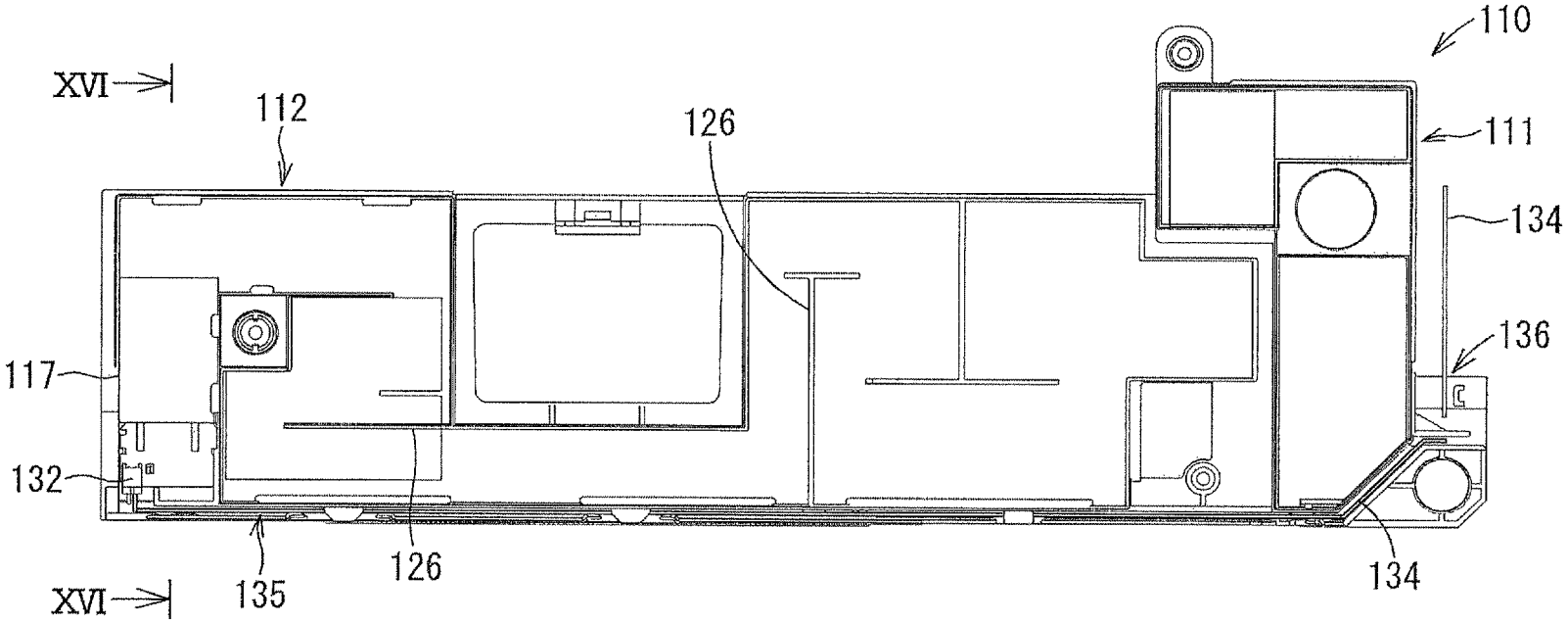
FIG. 14 is a plan view of a second waste-liquid tank in a first modification.
Figure 15:
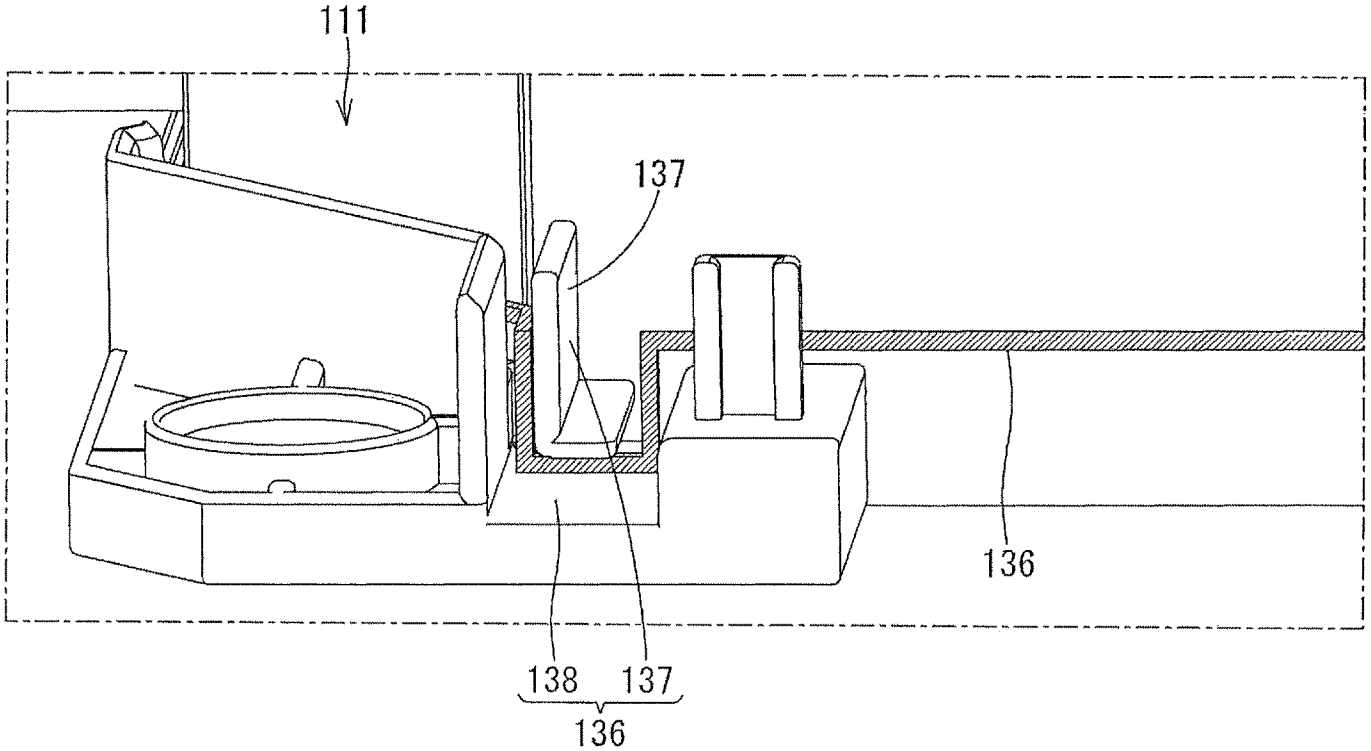
FIG. 15 is a partially enlarged perspective view of a portion of the second waste-liquid tank near a second cable supporter in the first modification.
Figure 16:
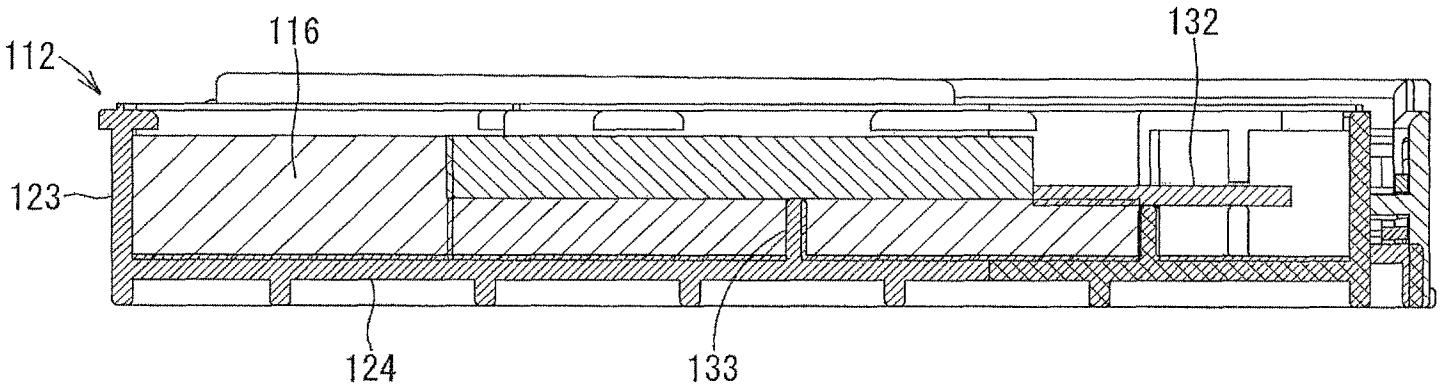
FIG. 16 is a cross-sectional view taken along line XVI-XVI in FIG. 14.

As illustrated in FIGS. 14-16, for example, a sensor 132 is disposed on a front left portion of the second body 112 of the second waste-liquid tank 110 at a position inside the side wall 117. The front left portion of the second body 112 inside the side wall 117 is a most downstream portion of a path of the waste ink which is defined by the ribs 126 provided on the second body 112. A well-known sensor may be employed for the sensor 132 as long as the sensor can electrically detect the ink.

As illustrated in FIG. 16, a rib 133 is provided in the inner space of the second body 112 at a rear of the front left portion at which the sensor 132 is provided. The rib 133 protrudes in the up direction 4 from the bottom board 124 of the second body 112 and extends in the right and left directions 8, 9. An upper end of the rib 133 is located below the upper end of the side wall 117. In the second body 112, for example, the rib 133 inhibits flow of the waste ink flowing in the ink absorber 116 toward the sensor 132 along the bottom board 124. When an amount of the waste ink accumulated in a corner portion defined by the bottom board 124 and the rib 133, a surface of the waste ink rises along the rib 133 in the up direction 4. When the surface of the waste ink reaches the upper end of the rib 133, the waste ink crosses the upper end so as to flow to the front left portion inside the side wall 117 at which the sensor 132 is provided. This construction results in a long ink passage to the sensor 132 for sensing the waste ink, enabling a large portion of the ink absorber 116 to absorb the waste ink.

As illustrated in FIG. 14, a first cable supporter 135 is formed in front of the first body 111 and the second body 112. The first cable supporter 135 supports a cable 134 extending from the sensor 132. The first cable supporter 135 is a groove which opens in the up direction 4 and extends in the right and left directions 8, 9. The first cable supporter 135 extends from the front left portion of the second body 112 at which the sensor 132 is provided, to a front right portion of the first body 111. The cable 134 is held and supported in the groove of the first cable supporter 135 so as not to move in the front direction 6 away from the first body 111 and the second body 112.

As illustrated in FIG. 15, a second cable supporter 136 for supporting the cable 134 is formed to the right of the first body 111. The second cable supporter 136 includes: a guide 137 that guides the cable 134 supported by the first cable supporter 135 further in the down direction 5; and a nip portion 138 for holding the cable 134 such that the cable 134 is nipped between the guide 137 and the cable 134. The guide 137 and the nip portion 138 are spaced apart from each other in the up and down directions 4, 5 and protrude in the right direction 8 from the side wall 117 of the first body 111. The cable 134 supported by the first cable supporter 135 is curved in the down direction 5 by the guide 137, and the curved portion of the cable 134 is nipped by the guide 137 and the nip portion 138, making it difficult for the cable 134 to be drawn in the rear direction 7. Thus, the second waste-liquid tank 110 and the cable 134 are united with each other. Accordingly, when removing the second waste-liquid tank 110 from the lower cover 30, it is difficult for the cable 134 to move away from the second waste-liquid tank 110, facilitating the removal.

Figure 17:
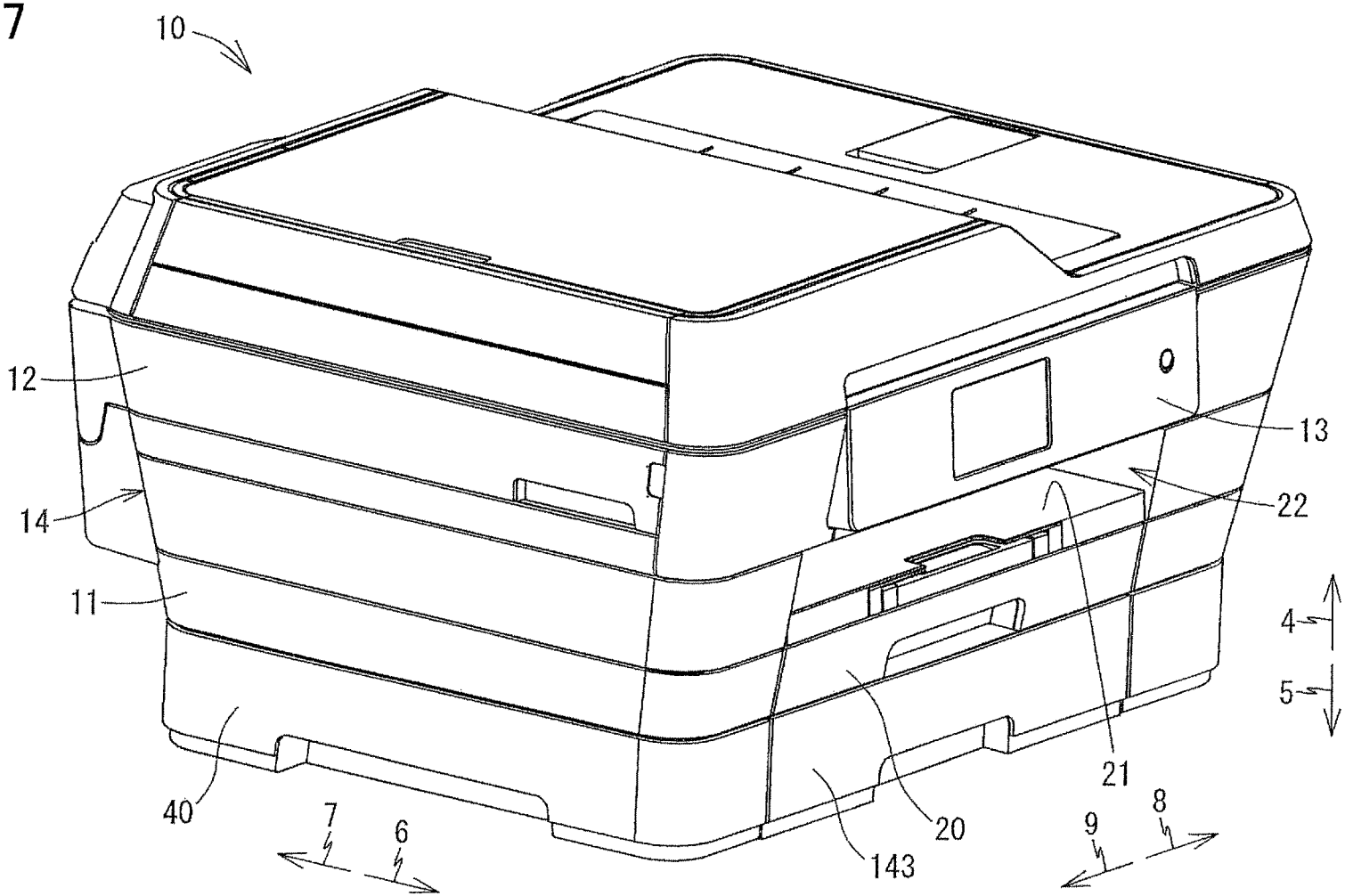
FIG. 17 is a perspective view of an MFP according to a second modification.

As illustrated in FIG. 17, the MFP 10 may be configured such that a supply tray 143 is selectively mounted in a space defined under the supply tray 20. This configuration enables the supply trays 20, 143 to accommodate sheets of different types and sizes and the image recorder 24 to perform image recording on the sheets without replacement of the sheets.

As described above, the supply tray 20 is mounted in the space 34 of the lower cover 30 and supported by the lower cover 30. The supply tray 20 is one example of a first sheet tray, and the lower cover 30 is one example of a third housing. As illustrated in FIG. 17, a housing 40 constituting portions of the front, side, and rear surfaces of the MFP 10 is assembled to the lower cover 30 of the printer housing 11, and the supply tray 143 is supported by the housing 40. The housing 40 is one example of a fourth housing, and the supply tray 143 is one example of a second sheet tray. The supply tray 143 is similar in construction to the supply tray 20 and capable of supporting a plurality of sheets stacked on each other. Though not illustrated, a supply arm, a supply roller, and a conveyance path are provided over the supply tray 143 in the housing 40. An uppermost one of the sheets supported on the supply tray 143 is supplied by the supply roller into the conveyance path and then conveyed from the conveyance path to the conveyance path 23.

Figure 18:
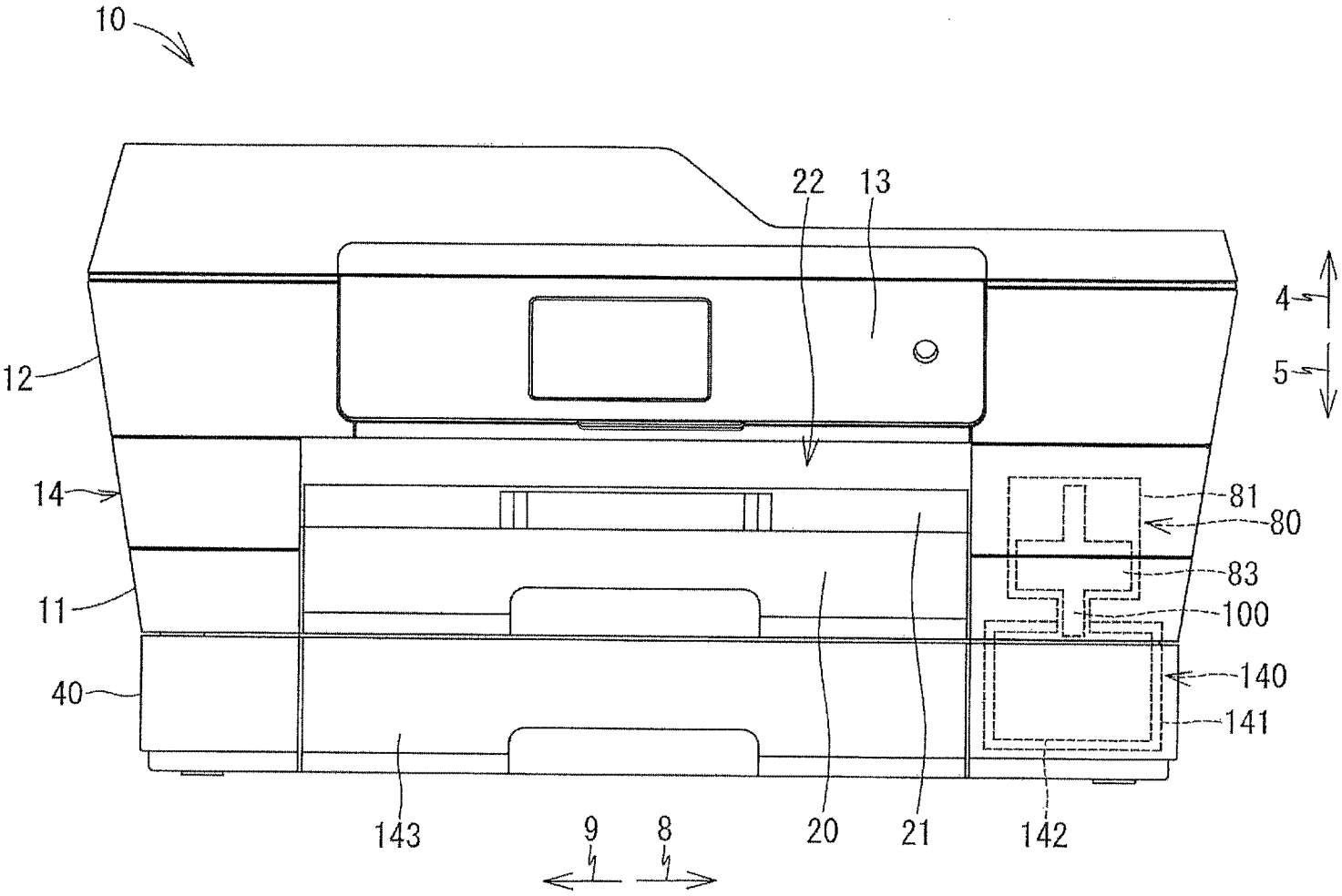
FIG. 18 is a front elevational view of the MFP according to the second modification.

As illustrated in FIG. 18, as described above, the first waste-liquid tank 80 is disposed in the space 35 of the lower cover 30 constituting the printer housing 11. The second waste-liquid tank 110 is not provided under the printer housing 11, and a third waste-liquid tank 140 as one example of a third waste-liquid storage is provided instead of the second waste-liquid tank 110. The third waste-liquid tank 140 is located to the right of the supply tray 143 in the housing 40 and does not extend to a lower side of the supply tray 143. It is noted that the first waste-liquid tank 80 and the third waste-liquid tank 140 are indicated by the broken lines in FIG. 18.

The third waste-liquid tank 140 includes a body 141 shaped like a box and filled with an ink absorber 142. The third waste-liquid tank 140 opens in the up direction 4. The cylindrical portion 87 of the first waste-liquid tank 80 is located in this opening. The first protrusion 100 of the ink absorber 83 which protrudes from this cylindrical portion 87 is in contact with the ink absorber 142 of the third waste-liquid tank 140. This construction enables the waste ink to flow from the first waste-liquid tank 80 to the third waste-liquid tank 140. Accordingly, in the case where the housing 40 and the supply tray 143 are selectively attached as options, the third waste-liquid tank 140 can be disposed with effective use of the inner space of the housing 40.

In the above-described embodiment, the purging mechanism 70 sucks the ink from the recording head 65, and the waste ink is received by the caps 74, 75. Instead of this construction, a purging mechanism of what is called a pushing purging type may be employed. That is, the MFP 10 may be configured such that a pump is provided between the recording head 65 and the ink cartridges, and the pump is operated to apply pressure to ink passages formed in the recording head 65 to push the ink out of the recording head 65. In this construction, the caps 74, 75 do not necessarily cover the nozzles 69 of the recording head 65, and the caps 74, 75 may be spaced apart from the nozzles 69 as long as the caps 74, 75 can receive the waste ink discharged from the nozzles 69 of the recording head 65.

The lid 82 may be provided with protrusions to be in contact with the second protrusion 102 of the ink absorber 83 to press the ink absorber 83 in the down direction 5, for example. These protrusions apply a pressing force to the ink absorber 83 in the down direction 5 in the body 81, whereby the first protrusion 100 of the ink absorber 83 reliably protrudes from the cylindrical portion 87 to the outside.

While the first waste-liquid tank 80 and the second waste-liquid tank 110 are arranged in the up and down directions 4, 5 in the above-described embodiment, the present disclosure is not limited to this arrangement. For example, the first waste-liquid tank 80 and the second waste-liquid tank 110 may be arranged in the front and rear directions 6, 7 or the right and left directions 8, 9. In this construction, the first protrusion 100 of the ink absorber 83 of the first waste-liquid tank 80 may protrude from the body 81 to the outside in the front direction 6, the rear direction 7, the right direction 8, or the left direction 9.

What is claimed is:

1. A liquid consuming apparatus, comprising:
a liquid consumer that consumes liquid;
a liquid receiver that receives the liquid discharged from the liquid consumer;
a first waste-liquid storage comprising a first housing connected to the liquid receiver so as to allow communication of the liquid between the first housing and the liquid receiver, and a first liquid absorber disposed in the first housing, a portion of the first liquid absorber passing a first opening of the first housing such that the portion of the first liquid absorber protrudes from an end of the first housing to an outside of the end of the first housing and an end of the portion of the first liquid absorber is located at the outside of the end of the first housing; and
a second waste-liquid storage comprising a second housing connected to the first waste-liquid storage so as to allow communication of the liquid between the second housing and the first waste-liquid storage, and a second liquid absorber disposed in the second housing,
the first housing comprising the first opening that opens toward the second housing,
the second housing comprising a second opening that opens toward the first housing,
the first liquid absorber protruding from the first opening to an outside of the first housing,
the second liquid absorber being in contact with the first liquid absorber protruding from the first opening.

2. The liquid consuming apparatus according to claim 1, wherein the first housing is located on an upper side of the second housing.

3. The liquid consuming apparatus according to claim 1, wherein the first housing comprises an inner wall defining the first opening, and a space is formed between the inner wall and the first liquid absorber.

4. The liquid consuming apparatus according to claim 1, wherein the first housing comprises a side surface, a bottom surface, and a rib that protrudes from the side surface to an inner space of the first housing and that extends to the bottom surface in an up and down direction, and
wherein the first liquid absorber is in contact with the rib.

5. The liquid consuming apparatus according to claim 1, wherein the first housing comprises a positioning member located on an upper side of the first opening and in contact with an upper surface of the first liquid absorber.

6. The liquid consuming apparatus according to claim 5, wherein the first housing comprises a third opening in addition to the first opening formed in a bottom portion of the first housing, and the third opening opens upward, and
wherein the third opening is sealed with the positioning member.

7. The liquid consuming apparatus according to claim 6, wherein the positioning member comprises:
at least one port communicating with an inner space of the first housing; and
a tube supporter that supports a tube connected to the at least one port and the liquid receiver.

8. The liquid consuming apparatus according to claim 7, wherein the tube supporter supports the tube extending upward from the at least one port, such that the tube is curved downward.

9. The liquid consuming apparatus according to claim 8, wherein the positioning member comprises two ports as the at least one port, and
wherein the first liquid absorber divides the inner space of the first housing into a space communicating with a first port of the two ports and a space communicating with a second port of the two ports.

10. The liquid consuming apparatus according to claim 1, wherein the second housing comprises a sheet formed with the second opening and sealing an opening of the second housing which opens upward.

11. The liquid consuming apparatus according to claim 1, wherein the second housing comprises a rib protruding upward from a bottom surface of the second housing and bent in a hook shape.

12. The liquid consuming apparatus according to claim 1, further comprising a sensor disposed in the second housing and configured to sense the liquid,
wherein the second housing comprises:
a first cable supporter that supports a cable extending from the sensor; and
a second cable supporter comprising (i) a guide that guides the cable to a position located below a position at which the first cable supporter supports the cable and (ii) a nip portion that holds the cable with the guide, with the cable interposed between the nip portion and the guide.

13. An ink-jet printer comprising:
an ink-jet head;
a first waste-ink storage comprising a first housing and a first liquid absorber disposed in the first housing;
a second waste-ink storage comprising a second housing and a second liquid absorber disposed in the second housing, a portion of the first liquid absorber passing a first opening of the first housing such that the portion of the first liquid absorber protrudes from an end of the first housing to an outside of the end of the first housing and an end of the portion of the first liquid absorber is located at the outside of the end of the first housing; and
a waste-ink path connected to the first waste-ink storage, the waste-ink path being connectable to the ink-jet head, wherein the first waste-ink storage is communicated with the ink-jet head via the waste-ink path when the waste-ink path is connected to the ink-jet head,
the first liquid absorber protruding to an outside of the first housing,
the second liquid absorber being in contact with the first liquid absorber protruding from the first housing.

14. A liquid consuming apparatus, comprising:

a liquid consumer that consumes liquid;

a liquid receiver that receives the liquid discharged from the liquid consumer;

a first waste-liquid storage comprising a first housing connected to the liquid receiver so as to allow communication of the liquid between the first housing and the liquid receiver, and a first liquid absorber disposed in the first housing;

a second waste-liquid storage comprising a second housing connected to the first waste-liquid storage so as to allow communication of the liquid between the second housing and the first waste-liquid storage, and a second liquid absorber disposed in the second housing, the first housing comprising a first opening that opens toward the second housing, the second housing comprising a second opening that opens toward the first housing, the first liquid absorber protruding from the first opening to an outside of the first housing, the second liquid absorber being in contact with the first liquid absorber protruding from the first opening, a third housing accommodating the liquid consumer and the first waste-liquid storage;

a first sheet tray supported by the third housing;

a fourth housing mountable on and removable from a lower side of the third housing selectively;

a second sheet tray supported by the fourth housing; and a third waste-liquid storage disposed in the fourth housing and connectable to the second waste-liquid storage and the first waste-liquid storage selectively, wherein the second waste-liquid storage is mountable on and removable from the third housing below the first sheet tray, and wherein the third waste-liquid storage is located on a side of the second sheet tray.

* * * * *